US006595816B2

(12) United States Patent
Jougla

(10) Patent No.: US 6,595,816 B2
(45) Date of Patent: Jul. 22, 2003

(54) DEVICE FOR REMOVABLY ATTACHING AN OAR TO A BOAT

(75) Inventor: Daniel Jougla, Labege (FR)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 10/161,784

(22) Filed: Jun. 4, 2002

(65) Prior Publication Data

US 2003/0008574 A1 Jan. 9, 2003

(30) Foreign Application Priority Data

Jul. 6, 2001 (FR) ..... 01 07445

(51) Int. Cl.[7] ..... B63H 16/06
(52) U.S. Cl. ..... 440/106; 440/104
(58) Field of Search ..... 440/102, 104–109; D12/215

(56) References Cited

U.S. PATENT DOCUMENTS 598,847 A * 2/1898 Boak et al. ..... 440/108
3,404,414 A 10/1968 Goserud
5,816,873 A 10/1998 Pestel

FOREIGN PATENT DOCUMENTS

| | | |
|---|---|---|
| FR | 1277007 | 11/1961 |
| FR | 1500783 | 11/1967 |
| FR | 1504805 | 12/1967 |

* cited by examiner

*Primary Examiner*—Jesus D. Sotelo
(74) *Attorney, Agent, or Firm*—Dean W. Russell; Kilpatrick Stockton LLP

(57) ABSTRACT

Device for removably securing an oar (3) to an edge of a boat, comprising an oarlock (4) accommodating a coupling member secured to the shaft (6) of the oar (3); the oarlock (4) comprises a base (7) supporting, via a spindle (22), a pivoting transverse arm (12) which has a cylindrical housing (13) opening into its front end (14) and locking means which have, to the rear and along the axis of the orifice of the housing (13), selectively a section provided with a hole (15) of the same diameter as the housing and a section provided with a hole (16) of a smaller diameter; a pivot (17) secured radially to the shaft (6) of the oar (3) having the same diameter as the housing (13) and hollowed by an annular groove (18) of a diameter equal to the smaller diameter of the locking means.

15 Claims, 4 Drawing Sheets

DEVICE FOR REMOVABLY ATTACHING AN OAR TO A BOAT

This application claims priority to French Application No. 0107445 filed on Jun. 7, 2001, the entire contents of which are incorporated by reference herein.

FIELD OF THE INVENTION

The present invention relates to improvements made to devices for removably attaching an oar to the edge of a boat, comprising an oarlock attached to said boat edge and a coupling member, attached to the shaft of the oar, for the removable attachment thereof to the oarlock; the invention is aimed in particular, although not exclusively, at such devices designed to equip inflatable boats.

DESCRIPTION OF THE PRIOR ART

Numerous examples of devices of the aforementioned kind are already known.

For example, document FR-A-2 754 237 recites such a device, for an inflatable boat, which is simple in structure and inexpensive (component parts few in number and which can be made of plastic), which is easy to use and which has no dangerous angular components.

However, this known device has the disadvantage that the oar presses only in one direction, that is to say that the thole pin presses against the oarlock only if the oar is subjected to a force directed outward (which, in principle, it is during use). However, there is no means of retention if the oar is subjected to a force directed toward the inside of the boat and the thole pin then disengages from the oarlock.

Another disadvantage of this known device lies in the fact that there is just one axis of rotation of the oar, namely the vertical axis of rotation of the thole pin about the retaining knob provided on the oarlock. By contrast, there is no concrete horizontal axis of rotation of the oar, and vertical travel of the oar can be obtained only by providing a very significant amount of vertical play between the oarlock retaining knob and the elongate slot in the thole pin that cooperates with said retaining knob.

The known device described in that document is thus not able to offer optimum rowing conditions.

SUMMARY OF THE INVENTION

The main object of the invention is to propose a device for securing an oar to the edge of a boat which is better able to meet the requirements of the users and which, while remaining simple in structure, inexpensive and non-aggressive, affords effective and reliable attachment of the oar capable of facilitating use while at the same allowing it to be fitted and removed without any difficulty.

To these ends, an oar attachment device as recited in the preamble part is one, arranged according to the invention, wherein:

a) the oarlock comprises

- a base arranged to be secured to said edge of the boat,
- a transverse pivoting arm supported on said base by a spindle substantially parallel to said edge of the boat so as to be capable of pivoting freely with a predetermined angular amplitude, said arm having a cylindrical housing opening into its front end,
- and locking means associated with said cylindrical housing and able to have, to the rear of the orifice of said housing and along the axis thereof, selectively a section provided with a hole of the same diameter as the housing and a section equipped with a hole of a smaller diameter, and b) a pivot secured to the shaft of the oar and projecting substantially radially from the latter, said pivot having a diameter substantially equal to that of said housing of the pivoting arm and being hollowed by an annular groove of smaller diameter substantially equal to that of the smaller-diameter hole of the locking means.

Advantageously, to form the locking means:

- the arm is arranged in hollow shape with an interior cavity,
- the arm has a lateral orifice in communication with said interior cavity, and
- the locking means comprise a sliding plunger, particularly in the form of a plate, engaged through said lateral orifice, protruding partially therefrom, on one side, and extending across said housing, on the other side, said plunger comprising said hole having substantially the same diameter as the housing and said hole of smaller diameter arranged one after the other in the direction in which said plunger slides, said both holes being partially secant and forming a single opening in the overall shape of an asymmetric 8.

In a preferred embodiment, the locking means comprise elastic return means able to return the plunger to a position of rest for which it is the smaller-diameter hole which is placed coaxially with said housing; and then, for preference, the elastic return means comprise at least one spring housed in said interior cavity of the arm and pressing against the plunger and, in one concrete exemplary embodiment, the spring may consist of a rigid strip of elastically deformable material, with one end secured to the plunger and with its other end anchored in the cavity; and then, in a simple way, the plunger and the elastically deformable strip forming the spring are formed integrally as one single piece; in a compact embodiment, the anchoring region of the strip is wound into an arc of a circle about the spindle of the pivoting arm, to which it is attached with preload, so as to generate the elastic return force returning the plunger.

To make it easier to fit the oar, it is conceivable for the free end of the pivot secured to the shaft of the oar to be shaped in an approximately conical or frustoconical shape: all that is then required is for the pivot to be pushed into the housing of the arm to snap-fasten it and axially retain it.

The pivot secured to the oar may be a component pushed directly radially into the shaft of the oar. However, in a preferred embodiment, the pivot secured to the shaft of the oar belongs to a thole pin comprising a ring able to grip firmly around the shaft of the oar, said pivot being secured to said ring approximately radially; in this case, provision may advantageously be made for the ring of the thole pin to be of oblong shape with a short transverse dimension appreciably smaller than the transverse dimension of the shaft of the oar.

Due to features according to the invention, not only a simple device having only a minimum number of component parts which are simple to manufacture is formed, but the pivot of the oar is also secured effectively and efficiently in both directions in the oarlock while at the same time forming a double rotary articulation, about two mutually orthogonal axes, of the oar with respect to the base of the oarlock. What is more, the oar is particularly simple and quick to fit into the oarlock or remove therefrom.

Such a device may find a preferred application in equipping inflatable boats, by virtue of the base being shaped in such a way that it can be secured to the inflatable buoyancy fender of the boat.

BRIEF DESCRIPTION OF THE DRAWINGS

The invention will be better understood from reading the detailed description which follows of certain embodiments which are given purely by way of illustration. In this description, reference is made to the appended drawings in which.

DETAILED DESCRIPTION OF THE INVENTION

Figure 1:
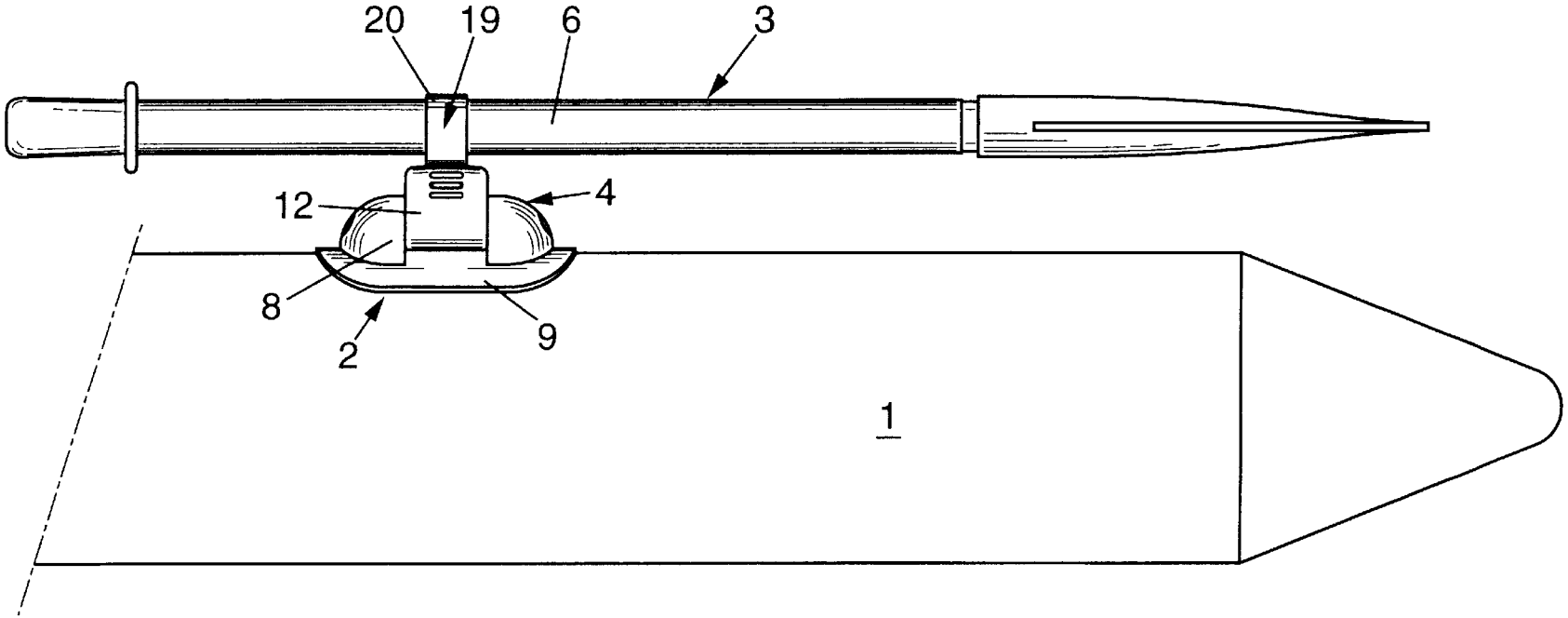
FIG. 1 is a partial side view of an inflatable fender of an inflatable boat provided with an oar attachment device according to the invention.
Figure 2:
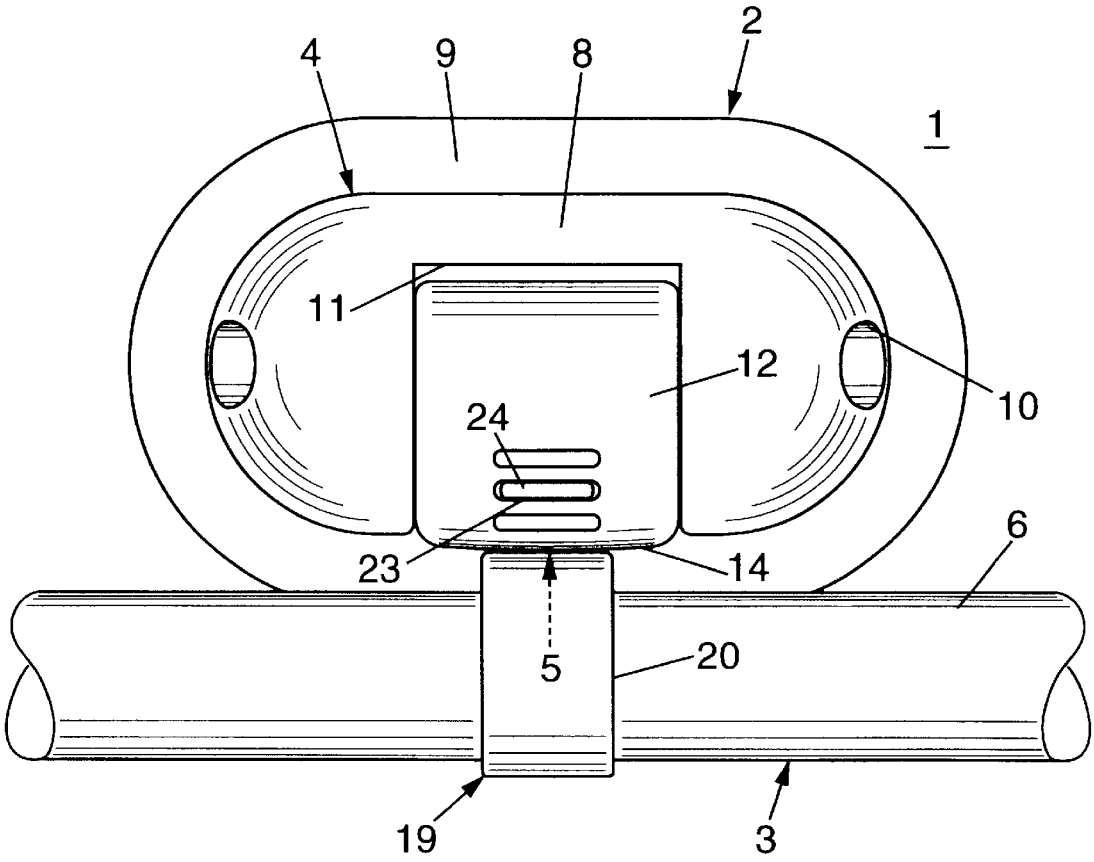
FIG. 2 is a view from above, on a larger scale, of the oar attachment device visible in FIG. 1.

FIG. 1 schematically depicts a part (the rear part) of a peripheral inflatable fender 1 of an inflatable boat which is equipped with an attachment device 2 arranged for supporting an oar 3 which is illustrated arranged substantially parallel to the fender 1. FIG. 1 is assumed to be a side view, the device 2 being attached approximately on the top of the fender and shown in a position for which the oar 3 extends over the fender 1.

The device 2 is illustrated on a larger scale, in a view from above, with the oar supported on the side of the device (swung through approximately 90° with respect to the depiction of FIG. 1).

The attachment device 2 is essentially made up of two assemblies, namely an oarlock 4 attached to the fender of the inflatable boat and a coupling member 5, attached to the shaft 6 of the oar 3, for removably attaching the latter to the oarlock 4.

The oarlock 4 essentially comprises

Figure 3:
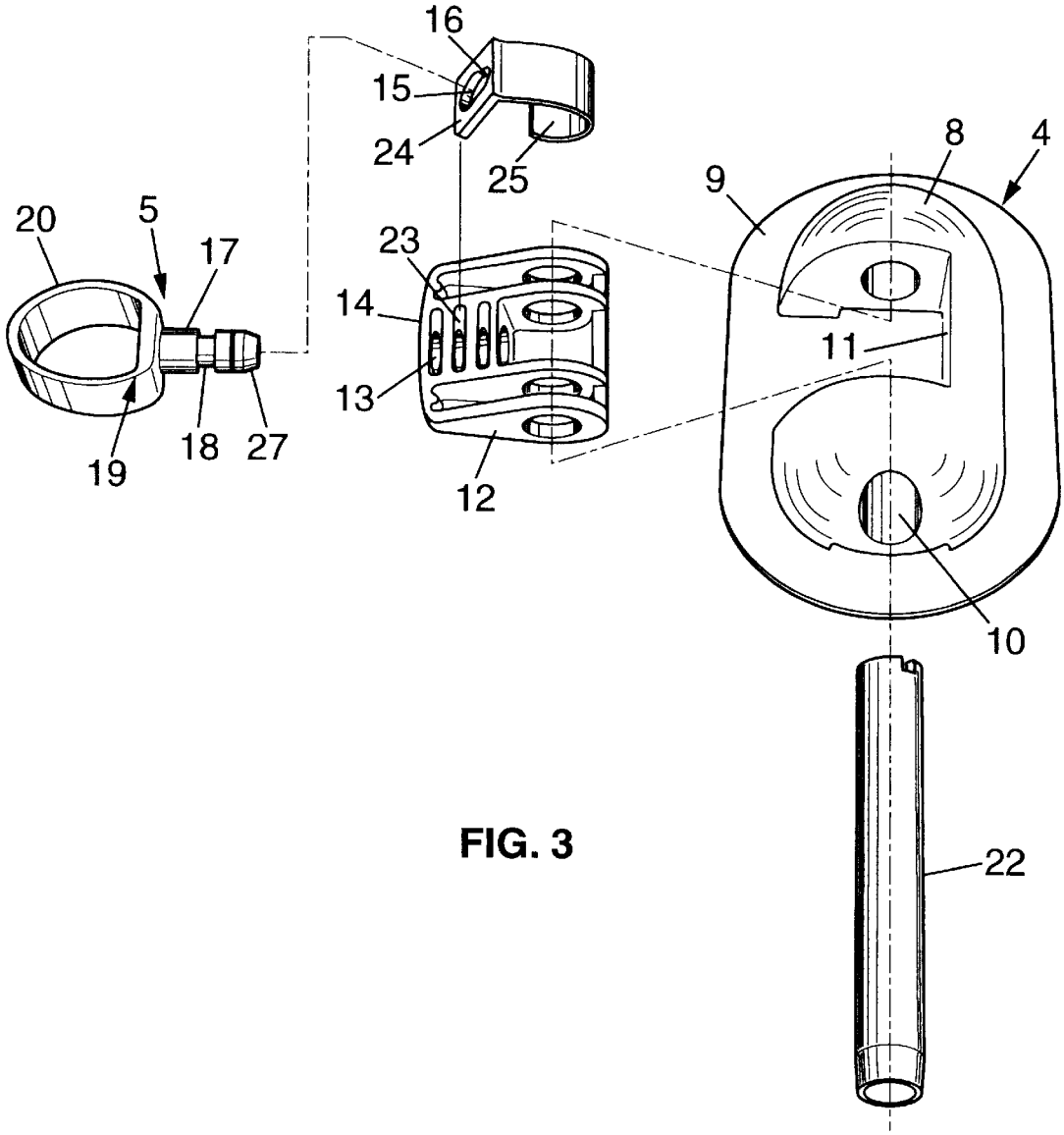
FIG. 3 is an exploded view showing, in perspective, the component elements of the device of FIG. 2.

- a base 7 designed to be able to be attached to the inflatable fender; this base may be in the form of a block or a shell 8 which may have any appropriate shape, preferably having no contusive parts or sharp edges; this shell 8 is provided, at its lower part, with a deformable (flexible or semi-flexible) sole 9 which is fixed under the shell 8 or is integral therewith and which is used for attachment to the inflatable fender 1, for example by bonding or by welding; this shell 8 has a through-bore 10 running substantially parallel to the fender 1 and an opening 11 opening laterally and upwards;
- a transverse arm 12 which is partially housed in said housing 11 and which is supported so that it can rotate freely by a spindle 22 (see FIG. 3) retained in the bore 10 of the base, so that this arm is able to pivot freely with a predetermined angular amplitude limited by the shape of the opening 11; the arm 12 has a cylindrical housing 13 opening into its front end 14 and extending into the arm 12 substantially transversely to the axis 13 of pivoting;
- and locking means associated with said cylindrical housing 13 of the arm 12 and arranged to have, to the rear of the orifice of said housing 13 and along the axis thereof, selectively a section provided with a hole 15 of substantially the same diameter as the housing 13 and a section with a hole 16 of smaller diameter (one concrete embodiment of this arrangement will be explained later on with reference in particular to FIG. 3).

Figure 6:
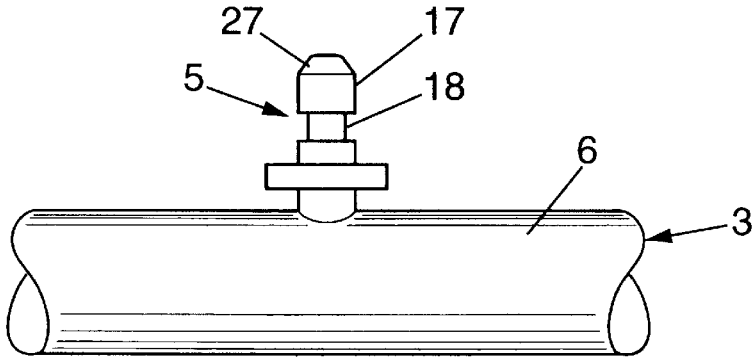
FIG. 6 illustrates an alternative form of embodiment of one of the elements of the device of the invention.

For its part, the coupling member 5 comprises a pivot 17 secured to the shaft 6 of the oar and which projects substantially radially therefrom (see FIGS. 3 and 6). This pivot 17 has a diameter substantially equal to that of said housing 13 of the pivoting arm 12 and that of said hole 15, and is hollowed by an annular groove 18 of smaller diameter substantially equal to that of said smaller-diameter hole 16 of the locking means.

In the preferred embodiment illustrated in FIGS. 1 to 5, the pivot 17 forms part of a thole pin 19 which comprises a ring 20 able to grip firmly around the shaft 6 of the oar, said pivot 17 running substantially radially from the ring 20. In a way known per se, the ring 20 may have an oblong shape with a short transverse dimension which is substantially smaller than the transverse dimension of the shaft 6 of the oar. This thus forms a removable thole pin which is easy to fit/remove only by force-fitting.

However, it is just as easy to imagine a simpler arrangement which, as illustrated in FIG. 6, consists in the pivot 17 being attached directly to the shaft 6 of the oar 3, for example being screwed radially into it.

To form the locking means in a simple and economical way with the minimum number of constituent parts, recourse may be had to the preferred embodiment which follows.

The arm 12 is arranged in hollow shape with an interior cavity 21 (FIGS. 4 and 5) into which the cylindrical housing 13 opens and through which the spindle 22 about which the arm 12 pivots passes.

In addition, the arm has a lateral orifice 23 which opens into said interior cavity 21.

Finally, the locking means comprise a sliding plunger 24, particularly in the form of a plate, engaged through said lateral orifice 23 protruding partially out of it above the surface of the arm, on one side, and extending across said cylindrical housing 13 on the other side. The plunger 24 is provided with said hole 15 of substantially the same diameter as the cylindrical housing 13 and with said hole 16 of substantially smaller diameter, which holes are arranged one after the other in the direction in which the plunger 14 slides; both holes 15 and 16 are also partially secant and constitute a single opening in the overall shape of an asymmetric 8.

This then forms a guillotine which, depending on its position, brings the smaller-diameter hole 16 into alignment with the cylindrical housing 13 by engaging in the groove 18 of the pivot 17 and which holds said pivot in the arm 12 (FIG. 4), or in other words which secures the oar 3 to the oarlock 4 with two degrees of freedom in rotation (articulation of the oar 3 with respect to the arm 12, and articulation of the arm 12 with respect to the base 8); or alternatively brings the larger-diameter hole 15 into alignment with the cylindrical housing 13 by allowing the pivot 17 to slide (FIG. 5), or in other words allowing the oar 3 to be fitted or removed.

Figure 4:
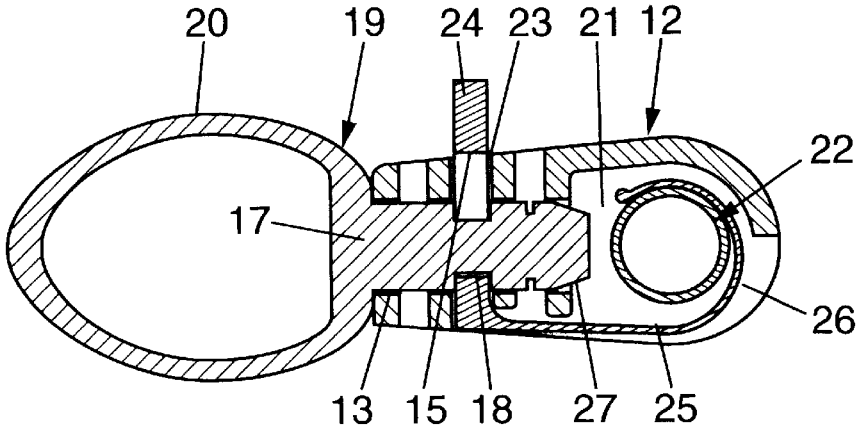
FIG. 4 is a view in section of part of the device of FIG. 2 with the thole pin shown in position in the device.

Advantageously, the locking means also comprise elastic return means able to return the plunger 24 to a position of rest for which it is the smaller-diameter hole 16 which is placed coaxially with said cylindrical housing 13 (the position illustrated in FIG. 4). It can thus be ensured that, if the pivot 17 of an oar is engaged in the housing 13 of the arm 12 of the oarlock 4, it will be retained automatically without the user having to perform a special action.

Figure 7:
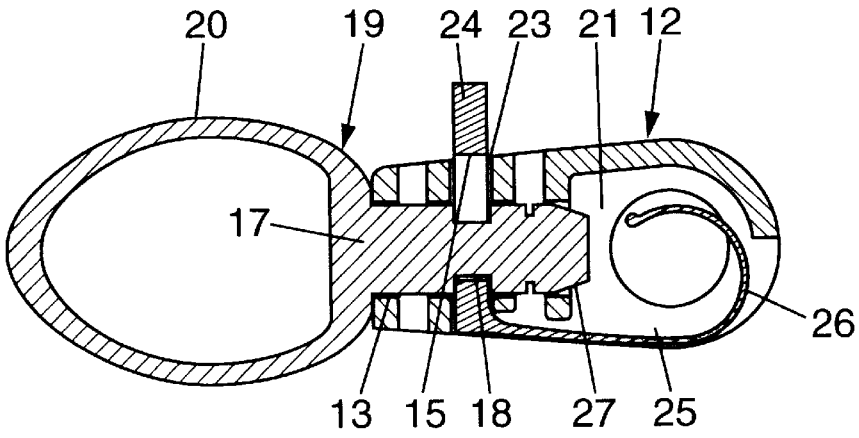
FIG. 7 is a sectional view of the arm of the device of FIG. 2 with the plunger spring not fitted.
Figure 5:
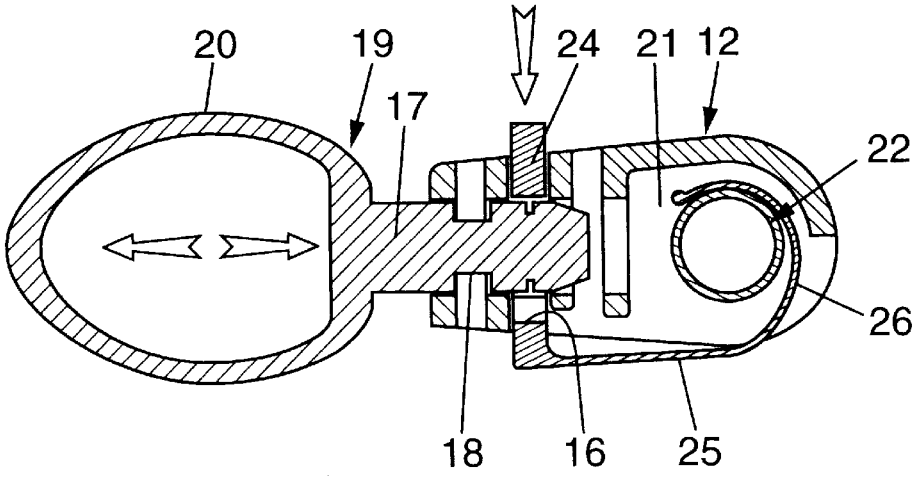
FIG. 5 is a sectional view similar to that of FIG. 4, the thole pin being in the process of being fitted or removed.

In the embodiment which is preferred on account of its simplicity, and which is illustrated in FIGS. 2 to 5, the elastic return means comprise at least one spring 25 housed in said interior cavity 21 of the oscillating arm 12 and presses against the plunger 24. This spring 25 advantageously consists of a rigid strip of elastically deformable material, with one of its ends secured to the plunger 24, particularly to the base thereof, and with its other end anchored in the cavity 21. In particular, as illustrated in FIGS. 4 and 5, provision may be made for this second end of the strip 25 to be wound into an arc of a circle about the spindle 22 of the oscillating arm to which it is attached with preload generated by the flexing of the strip 25. FIG. 7 depicts, in section, only the arm 12 with the plunger 24 and the strip 25 associated with it, the strip 25 being shown in its relaxed, unpreloaded shape which means that its end wound into an arc of a circle lies somewhat lower down than the space occupied by the spindle 22.

As a preference, as illustrated in FIGS. 3 to 5, the plunger 24 and the elastically deformable strip 25 forming a spring are formed integrally as a single piece, particularly of molded plastic.

To allow the single piece formed by the spring 24 and by the spring strip 25 to be fitted inside the arm 12, provision is made, as visible in FIGS. 4 and 5, for the bottom of the arm to be widely open at 28, so that the strip 25 can be introduced via there and bent to be preloaded when attached to the spindle 22.

To make the oar 3 easier to fit on the oarlock, provision may advantageously be made for the free end 27 of said pivot 17 to be shaped in an approximately conical or frustoconical shape, so that all that is required is for the pivot 17 to be pushed into the housing 13 in order for attachment to take place: the conical end 27 of the pivot 17 pushes back the plunger 24 which then drops into the groove 18 simply under the action of the spring 25.

By virtue of the arrangements of the invention which have just been described, there is produced a device for attaching an oar to a boat which comprises a reduced number of component parts; these parts are of simple design and shape and may advantageously be manufactured, by molding, in plastic; they are therefore inexpensive to manufacture and what is more they are simple and quick to assemble. Definitively speaking, this then forms a relatively inexpensive and robust device which has the advantage of having two orthogonal axes of articulation which make the oar easy to handle in use. Finally, the oar is remarkably simple to fit and to remove, while, in use, it is retained completely and cannot inadvertently disengage from its support.

The detailed description which has just been given of the arrangements of the invention has been given more specifically in the context of the equipping of an inflatable boat with an inflatable peripheral buoyancy fender, because it is in this application that the invention seems to be able to be exploited most advantageously. In particular, the shaping of the base 8 which has been explained, with its attachment sole 9, is characteristic of this application to inflatable boats.

However, the device of the invention is, in essence, not restricted to this single field of application to inflatable boats and could just as easily equip any type of boat or craft by giving the base 8 an appropriate shape that allows it to be fitted to and attached on the edge of the boat or craft.

What is claimed is:

1. A device for removably securing an oar to the edge of a boat, comprising an oarlock arranged to be secured to said edge of the boat and a coupling member arranged to be secured to the shaft of the oar, for removably securing it to the oarlock, and wherein:

a) the oarlock comprises a base arranged to be secured to said edge of the boat, a transverse pivoting arm supported on said base by a spindle substantially parallel to said edge of the boat so as to be capable of pivoting freely with a predetermined angular amplitude, said arm having a cylindrical housing opening into its front end, and locking means associated with said cylindrical housing and arranged to have, to the rear of the opening of the aforesaid housing, and along the axis thereof, selectively a section provided with a hole of the same diameter as the housing and a section provided with a hole of a smaller diameter, and b) a pivot secured to the shaft of the oar and projecting substantially radially from the latter, said pivot having a diameter substantially equal to that of said housing of the pivoting arm and being hollowed by an annular groove of smaller diameter substantially equal to that of the smaller-diameter hole of the locking means.

2. The device as claimed in claim 1, wherein, to form the locking means:

the arm is arranged in hollow shape with an interior cavity, the arm has a lateral orifice in communication with said interior cavity, and the locking means comprise a sliding plunger engaged through said lateral orifice, protruding partially therefrom, on one side, and extending across said housing, on the other side, said plunger comprising said hole of substantially the same diameter as the housing and said hole of smaller diameter arranged one after the other in the direction in which said plunger slides, said both holes being partially secant and forming a single opening in the overall shape of an asymmetric 8.

3. The device as claimed in claim 1, wherein the locking means comprise elastic return means able to return the plunger to a position of rest for which it is the smaller-diameter hole which is placed coaxially with said housing.

4. The device as claimed in claim 2, wherein the elastic return means comprise at least one spring housed in said interior cavity of the arm and pressing against the plunger.

5. The device as claimed in claim 2, wherein the elastic return means comprise at least one spring housed in said interior cavity of the arm and pressing against the plunger, and wherein the spring consists of a rigid strip of elastically deformable material, with one end secured to the plunger and its other end anchored in the cavity.

6. The device as claimed in claim 2, wherein the elastic return means comprise at least one spring housed in said interior cavity of the arm and pressing against the plunger, wherein the spring consists of a rigid strip of elastically deformable material, with one end secured to the plunger and its other end anchored in the cavity, and wherein the plunger and the elastically deformable strip forming the spring are formed integrally as one single piece.

7. The device as claimed in claim 2, wherein the elastic return means comprise at least one spring housed in said interior cavity of the arm and pressing against the plunger, wherein the spring consists of a rigid strip of elastically deformable material, with one end secured to the plunger and its other end anchored in the cavity, and wherein the anchoring region of the strip is wound into an arc of a circle about the spindle of the pivoting arm, to which it is attached with preload.

8. The device as claimed in claim 3, wherein the free end of the pivot secured to the shaft of the oar is shaped in an approximately conical or frustoconical shape.

9. The device as claimed in claim 1, wherein the pivot secured to the shaft of the oar belongs to a thole pin comprising a ring able to grip firmly around the shaft of the oar, said pivot being secured to said ring substantially radially.

10. The device as claimed in claim 9, wherein the ring of the thole pin has an oblong shape with a short transverse dimension substantially smaller than the transverse dimension of the shaft of the oar.

11. The device as claimed in claim 1, wherein the base is designed to be secured to an inflatable buoyancy fender of an inflatable boat.

12. The device as claimed in claim 3, wherein the elastic return means comprise at least one spring housed in said interior cavity of the arm and pressing against the plunger.

13. The device as claimed in claim 3, wherein the elastic return means comprise at least one spring housed in said interior cavity of the arm and pressing against the plunger, and wherein the spring consists of a rigid strip of elastically deformable material, with one end secured to the plunger and its other end anchored in the cavity.

14. The device as claimed in claim 3, wherein the elastic return means comprise at least one spring housed in said interior cavity of the arm and pressing against the plunger, wherein the spring consists of a rigid strip of elastically deformable material, with one end secured to the plunger and its other end anchored in the cavity, and wherein the plunger and the elastically deformable strip forming the spring are formed integrally as one single piece.

15. The device as claimed in claim 3, wherein the elastic return means comprise at least one spring housed in said interior cavity of the arm and pressing against the plunger, wherein the spring consists of a rigid strip of elastically deformable material, with one end secured to the plunger and its other end anchored in the cavity, and wherein the anchoring region of the strip is wound into an arc of a circle about the spindle of the pivoting arm, to which it is attached with preload.

* * * * *